United States Patent [19]

Fulton

[11] Patent Number: 4,728,103

[45] Date of Patent: Mar. 1, 1988

[54] LEG AND ANKLE EXERCISING DEVICE

[75] Inventor: Robert S. Fulton, Glenns Ferry, Id.

[73] Assignee: T.F.S. Inc., Gooding, Id.

[21] Appl. No.: 817,503

[22] Filed: Jan. 9, 1986

[51] Int. Cl.[4] ..... A63B 21/02

[52] U.S. Cl. ..... 272/137; 272/143; 272/142

[58] Field of Search ..... 272/93, 96, 135–139, 272/142, 143

[56] References Cited

U.S. PATENT DOCUMENTS

| | | | |
|---|---|---|---|
| 843,478 | 2/1907 | Muller | 272/139 |
| 1,671,096 | 5/1928 | Anderson | 272/96 |
| 1,952,750 | 3/1934 | Gailey | 272/137 |
| 2,097,376 | 10/1937 | Marshman | 272/139 |
| 2,160,722 | 5/1939 | Cunningham | 272/137 |
| 4,019,734 | 4/1977 | Lee et al. | 272/137 |
| 4,198,044 | 4/1980 | Holappa | 272/135 |
| 4,251,070 | 2/1981 | Leseberg | 272/143 |
| 4,596,387 | 6/1986 | Roberts | 272/143 X |

FOREIGN PATENT DOCUMENTS

| | | | |
|---|---|---|---|
| 2245272 | 3/1974 | Fed. Rep. of Germany | 272/143 |
| 2234017 | 1/1975 | France | 272/142 |

*Primary Examiner*—Richard J. Apley
*Assistant Examiner*—J. Welsh
*Attorney, Agent, or Firm*—Bacon & Thomas

[57] ABSTRACT

An exercising device for strengthening joints of the body, particularly the ankle joint, wherein a plate engageable against the foot of the user imparts controlled resistance in all directional movements of the joint through elastic limbs having one set of corresponding ends attached to predetermined points around the periphery of the plate and the other set of corresponding ends attached to a pair of handles which are gripped by the user for varying the degree of resistance imparted by the limbs.

7 Claims, 11 Drawing Figures

Fig. 1
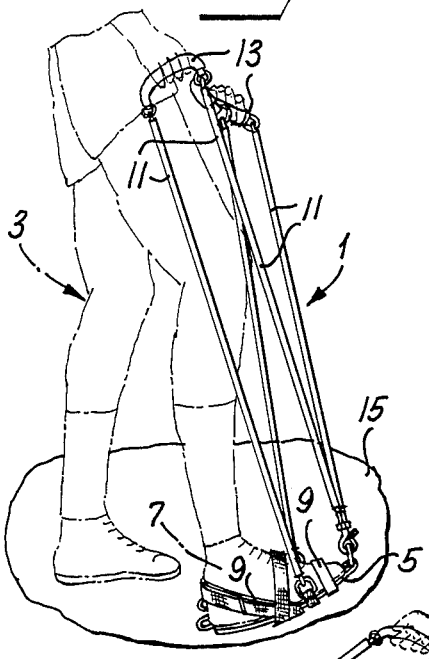
Fig. 2
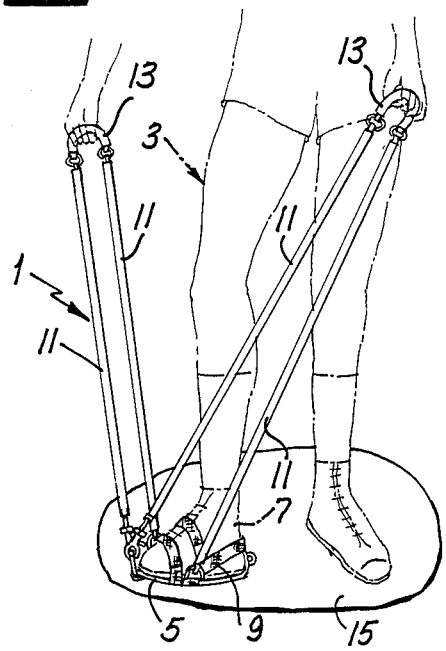
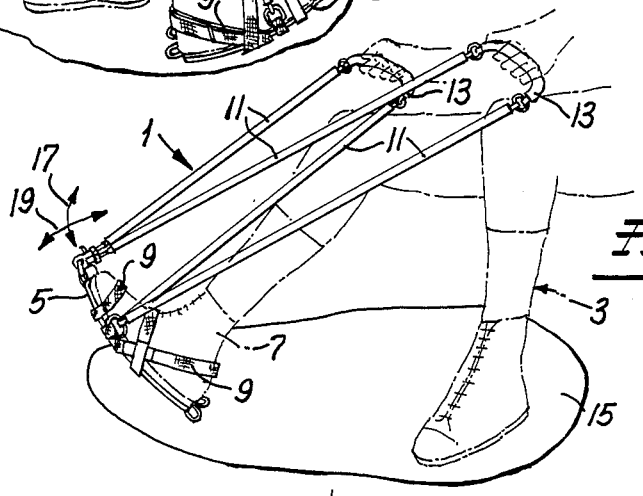
Fig. 3
Fig. 5
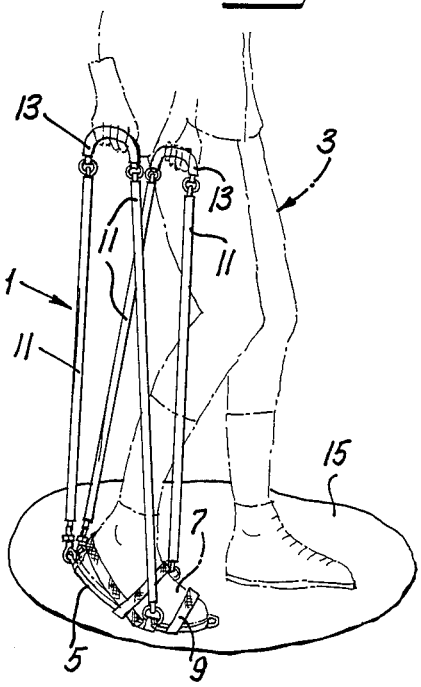
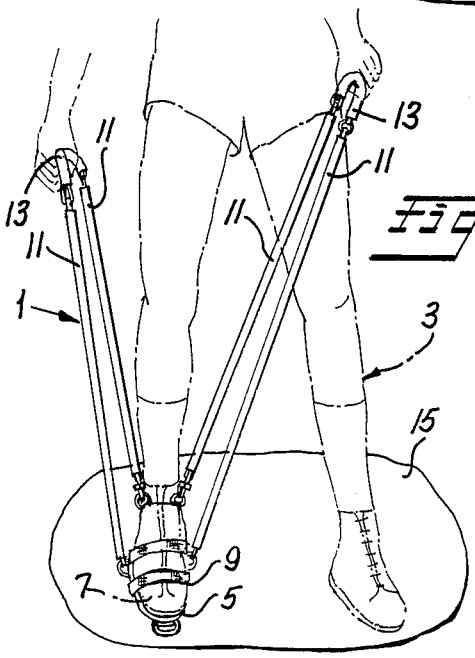
Fig. 4

LEG AND ANKLE EXERCISING DEVICE

BACKGROUND OF THE INVENTION

1. Field of the Invention

The present invention generally involves the field of technology pertaining to devices for exercising the human body. More particularly, the invention relates to an improved device for strengthening joints of the leg, and particularly the muscles, tendons and ligaments of the ankle joint.

2. Description of the Prior Art

It is well established that proper exercise serves to strengthen the muscles, tendons and ligaments of the human body, particularly in the areas surrounding the joints in order to prevent or rehabilitate various types of joint injuries. Different joints necessarily have different directional and angular movements which must be taken into consideration during exercise so that complete and balanced strengthening of a given joint can be fully realized.

The joints of the leg, including the knee joint and the ankle joint, are quite prone to injury. This is particularly of concern during athletic activities when an athlete imposes unusual degrees of stress to the joints from different directions which are normally not realized during nonathletic activities. Injuries sustained by the knee and ankle joints can be especially painful and debilitating because of the complex nature of these joints and the necessity for long term rehabilitation or complete recovery of such injuries.

The knee joint is substantially limited to providing pivotal movement of the lower leg with respect to the upper leg, as exemplified by the simple movement between knee extension and knee relaxation wherein the muscles of the upper leg or thigh are utilized. The ankle joint is more complex in its function since it undergoes essentially four basic movements, including planter flexion wherein the foot is rotated in a downward direction, dorsal flexion wherein the foot is rotated in an upward direction, inversion supination wherein the foot is rotated outwardly, and eversion pronation wherein the foot is rotated inwardly. These ankle movements are controlled by the muscles of the lower leg located at the front or anterior, the sides or media and lateral, and the back or posterior thereof. In order to properly strengthen the ankle joint for preventing injuries thereto or realize rapid rehabilitation of an injured ankle joint, it is necessary that all of the muscles, tendons and ligaments controlling all directions of ankle movements be directly exercised under controlled resistance conditions and resistance pressure be asserted over the planes defined by these movements.

The prior art has recognized the benefits of devices for exercising both the muscles and joints of the body wherein resistance is imparted by means of resilient members, such as springs or lengths of rubber bands. It is also known to utilize such devices for directly exercising the muscles and joints of both the upper and lower legs. Examples of devices believed to be indicative of the state of the art in this field of technology are taught by the U.S. Pat. Nos. 1,952,750 Gailey, 2,097,376 Marshman, 2,467,943 Mikell, Hinds et al 4,195,835, 4,251,070 Leseberg, and 4,478,414 Molloy.

It is well recognized that recent activity in the fields of exercising devices and sports medicine has been quite intense, particularly with regard to developments based on stringent scientific and medical considerations in order to provide optimum results. Exercising devices and related equipment are therefore being produced under high technology standards and based on sound principles of kinesiology and related factors. There has also been a recognized need for an improved device which is capable of providing full strengthening and rehabilitating effects to the muscles and joints of the leg, particularly the ankle joint, in a manner and with the results that are consistent with the high standards now expected in this field of technology.

SUMMARY OF THE INVENTION

It is an object of the present invention to provide an improved exercising device for strengthening the muscles and joints of the leg and providing rapid rehabilitation of injuries to such muscles and joints.

It is another object of the invention to provide an improved exercising device for specifically exercising and strengthening the muscles, ligaments and tendons associated with the knee and ankle joints of the leg.

It is a further object of the invention to provide an improved exercising device which is capable of exercising the ankle joints and all angular and directional movements of these joints.

It is yet another object of the invention to provide an exercising device for the muscles and joints of the leg wherein the device is extremely easy to use, efficient in operation and economical to manufacture.

These and other objects of the invention are realized by providing an exercising device which includes a plate having the general configuration of the sole of the foot and is detachably secured thereto, preferably by means of belts or Velcro straps. A plurality of elastic limbs have one set of corresponding ends attached to spaced connection points around the periphery of the plate, and their other set of corresponding ends attached to a pair of handles which are gripped by the user. The plate, by virtue of the connection points, defines a triangular-shaped plane to which controlled resistance is imparted by the elastic limbs, thereby permitting the leg joints, and particularly the ankle joints, to be exercised in virtually all their angles and directions of movement.

In a first embodiment, the plate is of substantially the same size and configuration as the sole of the foot and may be directly attached thereto or to the bottom of a shoe worn by the user. Two pairs of elastic limbs may have their one set of corresponding ends detachably connected to the toe and front sides of the plate or, alternatively, to the heel and front sides of the plate.

In a second embodiment, the plate may be substantially one-half the size of the sole of the foot, and have one set of corresponding ends of the elastic limbs connected to the toe and sides thereof, whereby the plate may be selectively attached to either the front portion or rear portion of the foot.

Other objects, advantages and features of the invention shall become apparent from the following detailed description of preferred embodiments thereof, with reference being made to the accompanying drawings wherein like reference characters refer to corresponding parts of the several views.

BRIEF DESCRIPTION OF THE DRAWINGS

FIGS. 1–5 are elevational views showing a first embodiment of an exercising device according to the invention in various applications of use;

DETAILED DESCRIPTION OF THE PREFERRED EMBODIMENTS

Figure 6:
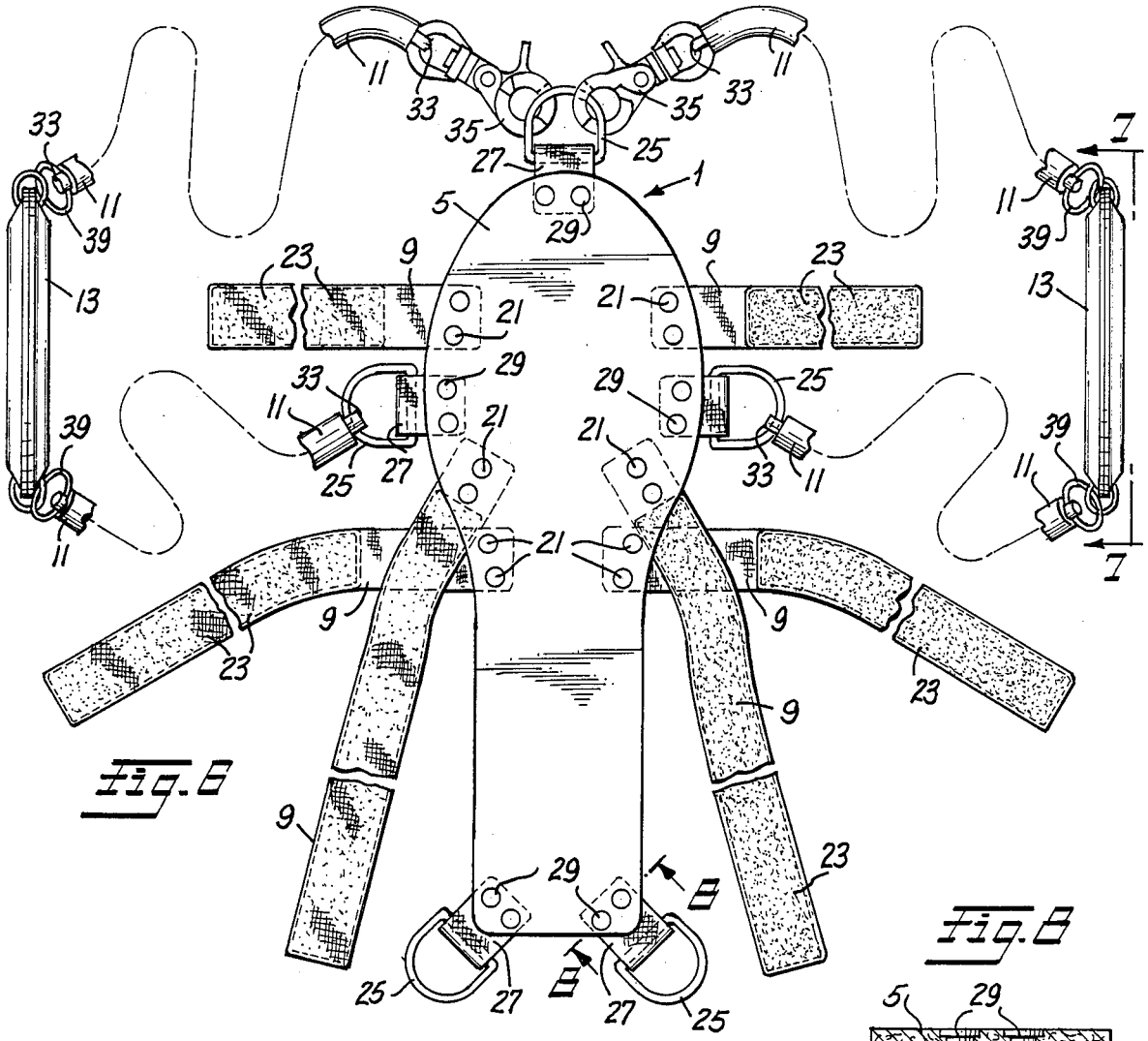
FIG. 6 is an enlarged fragmentary plan view of the exercising device of FIGS. 1-5.

An exercising device 1 according to a first embodiment of the invention is shown in various applications of use in FIGS. 1-5. With initial reference to FIGS. 1 and 2, device 1 is shown attached to the right foot of a user 3. Device 1 is basically defined by a planar-shaped plate 5 which is detachably secured either directly to the sole of the foot or to the bottom of a shoe 7 by means of appropriate straps 9. Device 1 also includes two pairs of elastic limbs 11 which have one set of corresponding ends detachably secured to three spaced connection points around the periphery of the front portion of plate 5 so as to define a triangular-shaped plane. The other set of corresponding ends of limbs 11 are secured to a pair of handles 13 which are gripped by user 3. As apparent from FIG. 1, user 3 may stretch limbs 11 in order to impart the desired degree of resistance to plate 5, the latter effectively defining a triangular-shaped plane of resistance. This permits the exercising of the ankle joint by raising and lowering the front portion of the foot against the resistance.

As seen in FIG. 2, the handles of device 1 are spread outwardly, thereby permitting the exercising of the ankle in sideway movements against controlled resistance. Another application of use is shown in FIG. 3 wherein user 3 is in a seated position, thereby permitting an even greater range of movement in the exercising of the ankle by device 1. In this latter case, the heel of the foot may either be supported on a surface 15 or maintained in the air off of surface 15. In either case, it is apparent that the ankle joint can be fully exercised by device 1 in planter flexion and dorsal flexion as indicated by double Arrow 17, and in both inversion supination and eversion pronation as indicated by double Arrow 19. Moreover, in this application of use, it is also possible to exercise the knee through its normal extension and relaxation movements.

In the application of use shown in FIGS. 4 and 5, the pair of limbs 11 attached to the extreme front portion or toe of plate 5 are removed and reattached to the extreme rear portion or heel of plate 5. This configuration permits exercising the ankle joint by applying resistance in a different direction, whereby the heel of user 3 may be raised and lowered against resistance in the manner more clearly shown in FIG. 5.

Figure 8:
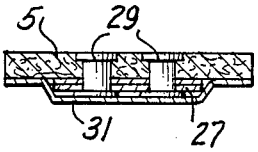
FIG. 8 is an enlarged vertical sectional view, through the plate of the exercising device, taken on the line 8—8 of FIG. 6.
Figure 7:
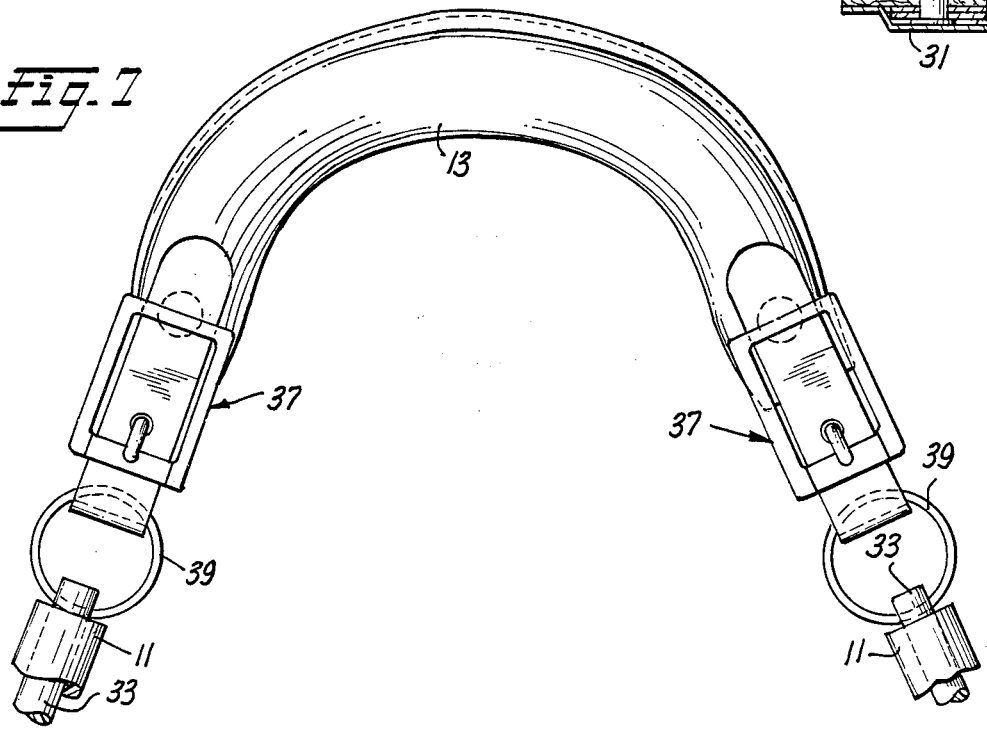
FIG. 7 is an enlarged front elevational view of a handle used with the exercising device, taken on the line 7—7 of FIG. 6.

The structural details of device 1 shall now be described with reference to FIGS. 6-8. As shown in FIG. 6, plate 5 is of a substantially planar-shaped configuration and preferably formed of semi-rigid material, such as leather, rubber, plastic or the like. Plate 5 is also substantially of the same size and configuration of the sole of the foot of user 3 or the bottom of shoe 7 worn by user 3. An essential aspect of plate 5 is that it defines a triangular-shaped plane to which resistance is imparted around the periphery thereof at three spaced connection points. It is further possible that plate 5 may actually form the permanent sole portion of a shoe rather than be detachably secured to the bottom of shoe 7 as shown in FIGS. 1-5.

An appropriate number of straps 9 are secured by means of rivets 21 or similar fasteners around the periphery of plate 5 to permit its detachable connection to the foot or shoe 7 of user 3. Straps 9 are preferably formed from natural or synthetic materials, such as leather or woven nylon, and provided with Velcro attachments 23 which permit rapid connection and disconnection of straps 9 around the foot of user 3. It is also possible that straps 9 be provided with metal buckles or other types of connectors well known in the art and deemed suitable for the practice of the invention as disclosed herein.

As further seen in FIG. 6, a plurality of metal rings 25 are secured at specified locations to the toe, front side and heel portions of plate 5 by means of fabric loops 27 and rivets 29 or other appropriate fastening means. It is important to note that rings 25 are attached around the periphery of plate 5 in such a manner as to permit device 1 to exercise the ankle through application of resistance to both the front and rear portions of the foot as previously described herein. As seen in FIG. 8, each fabric loop 27 is secured by rivets 29 to plate 5 in the same basic manner as each strap 9 is secured by its corresponding rivets 21. A protective cover 31 of plastic or other appropriate material may be laminated onto the bottom of plate 5, thereby sealing and concealing the ends of straps 9, fabric loops 27 and their respective rivets 21 and 29.

Each limb 11 is preferably formed from tubular elastic material, such as surgical tubing or the like. It is also understood that limbs 11 may each comprise a metal spring or other such equivalent elastic mamber well known in the art. The opposite ends of each limb 11 is provided with a tightly fitted plastic plug 33 having an exposed aperture. As seen in FIG. 6, the corresponding ends of limbs 11 secured to plate 5 may either be secured directly to rings 25 or a pair of snap swivels 35 which in turn are secured directly to a ring 25. It is therefore clear that the ends of limbs 11 secured by snap swivels 35 to ring 25 located at the toe of plate 5 may be detached and reconnected to the two rings 25 secured to the heel of plate 5 in order to permit the alternative application of use for device 1.

The other corresponding ends of each pair of limbs 11 are connected to handles 13. As seen in FIG. 7, each handle 13 may be formed of leather or other appropriate material, and provided with a pair of buckle assemblies 37 of known configuration at the opposite ends thereof. Each buckle assembly 37 includes a ring 39 that is in turn secured through the aperture of plastic plug 33 carried by the end of corresponding limb 11. However, the construction of handle 13 and its manner of attachment to limbs 11 may of course be in any form well known in the art so long as handle 13 is securely attached to limbs 11 and may be easily gripped by user 3 for exercising with device 1 in the manner disclosed herein.

Figure 9:
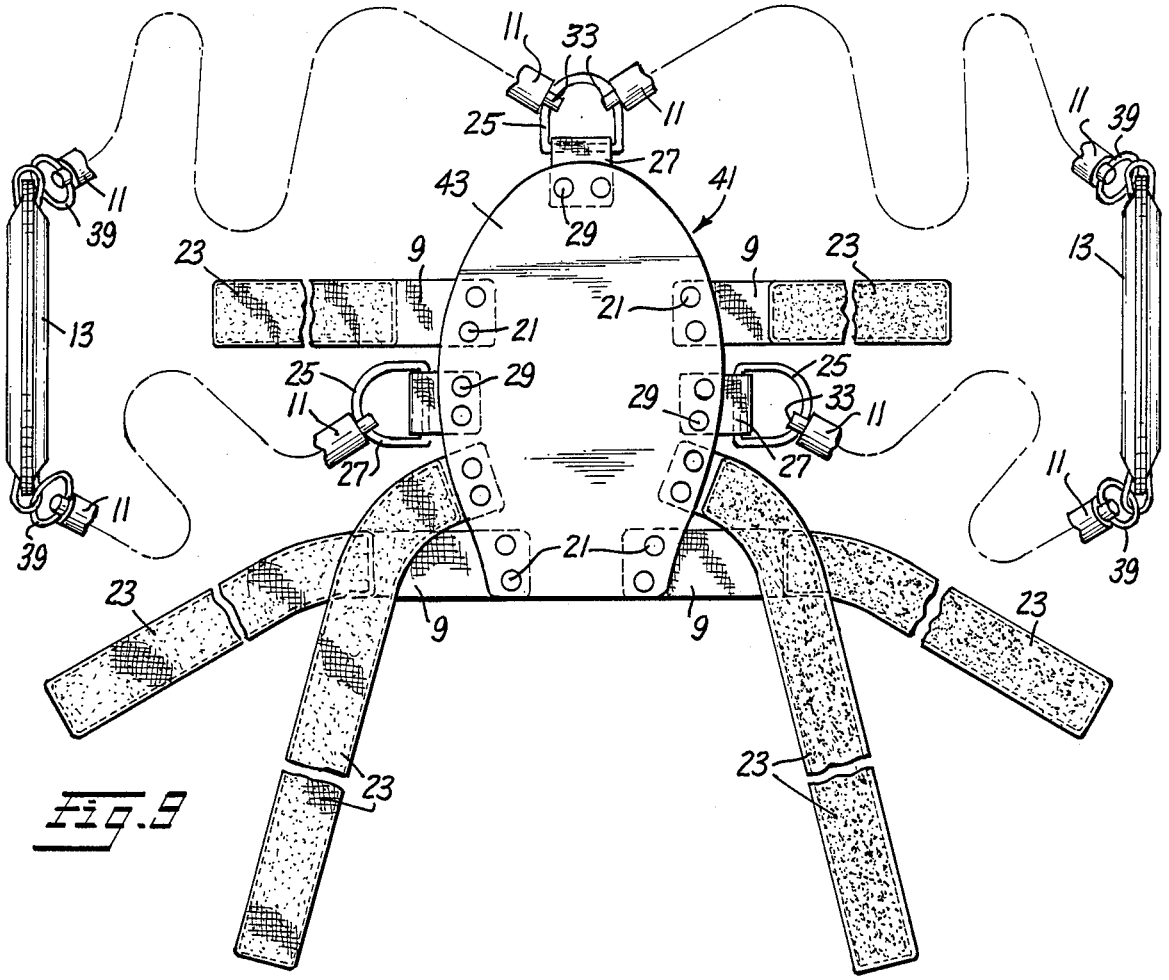
FIG. 9 is a fragmentary plan view of an exercising device according to a second embodiment of the invention.

An exercising device 41 according to a second embodiment of the invention shall now be described with reference to FIGS. 9–11. As particularly seen in FIG. 9, device 41 differs from device 1 of the first embodiment inasmuch as a plate 43 is provided having approximately half the size of plate 5. In a preferred form, plate 43 is of the same configuration and size as the front half portion of plate 5. This constitutes the primary difference between device 41 and device 1. Moreover, snap swivels 35 are eliminated and plastic plugs 33 of limbs 11 may be connected directly to ring 25 located at the toe of plate 43. The remaining structural details of device 41 are exactly the same as previously described for device 1.

Figure 10:
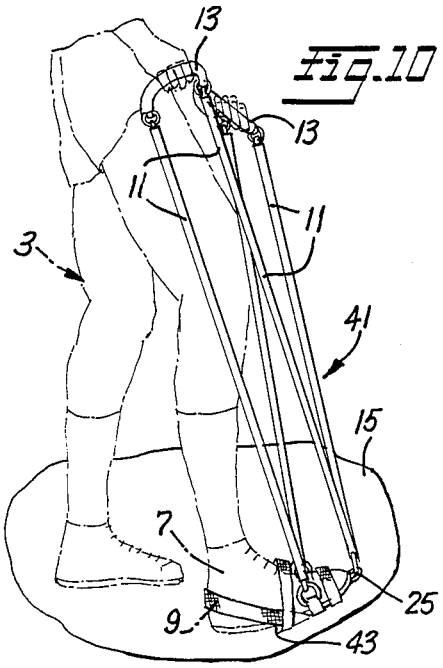
FIG. 10 is an elevational view, showing the exercising device of FIG. 9 depicted in a first position of use wherein the plate is attached to the front portion of the foot.
Figure 11:
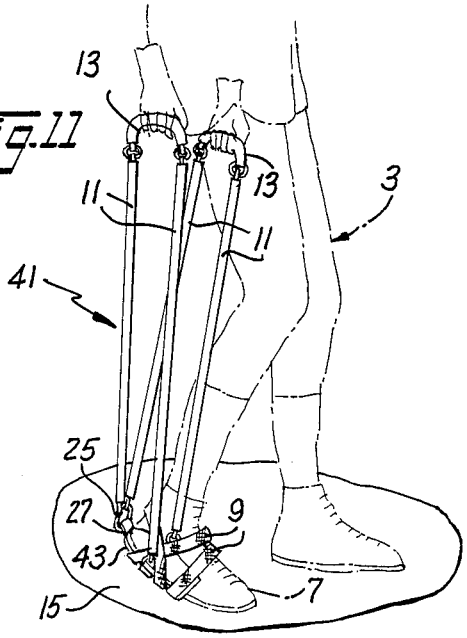
FIG. 11 is an elevational view of the exercising device of FIG. 9 shown in a second position of use wherein the plate is attached to the rear portion of the foot.

As shown in FIG. 10, plate 43 of device 41 may be attached to the front portion of shoe 7 for exercising the ankle in the same basic manner as previously described for FIGS. 1–3. When plate 43 is shifted and reattached to the heel or rear portion of shoe 7 as shown in FIG. 11, device 41 may be utilized in the same manner as previously described for FIGS. 4 and 5.

It is to be understood that the forms of the invention herein shown and described are to be taken as merely preferred embodiments of the same, and that various changes in shape, material, size and arrangement of parts may be resorted to without departing from the spirit of the invention or scope of the subjoined claims.

I claim:

1. An exercising device for exercising the joints of the leg, particularly the ankle joint, which device comprises:

(a) a substantially planar-shaped plate;

(b) means for detachably securing the plate to the foot of a user;

(c) a plurality of connection means one on each side of the plate and at least one at either the toe or heel of the plate, thereby defining at least three spaced connection points around the periphery of the plate;

(d) a plurality of elongate elastic limbs, each limb including a first end and a second end;

(e) the first ends of the limbs being detachably securable to the plate at the three spaced connection points such that a substantially triangular-shaped pattern is formed;

(f) the second ends of the elastic limbs being provided with handle means for gripping by the hands of the user; and (g) whereby stretching of the elastic limbs by the user causes the triangular-shaped plane of the plate to provide controlled resistance against all angular and directional movements of the joint.

2. The exercising device of claim 1 wherein the elastic limbs are defined by two pairs of elastic limbs, the first ends of one pair being detachably securable to the opposite sides of the plate and the first ends of the other pair being selectively detachably securable to either the toe or the heel of the plate.

3. The exercising device of claim 1 wherein the elastic limbs are each formed of tubular rubber and the handle means includes a pair of handles.

4. The exercising device of claim 1 wherein the plate corresponds substantially in size and configuration to the front half of the sole of the foot of the user, and the means for detachably securing the plate permits the plate to be selectively secured to either the front portion or rear portion of the foot.

5. The exercising device of claim 1 wherein the means for detachably securing the plate to the foot of the user includes a plurality of straps provided with attachment means at the ends thereof.

6. The exercising device of claim 5 wherein the attachment means include Velcro connectors.

7. The exercising device of claim 1 wherein the plate is formed of semi-rigid material.

* * * * *